US010698437B1

(12) United States Patent
Kuo et al.

(10) Patent No.: US 10,698,437 B1
(45) Date of Patent: Jun. 30, 2020

(54) FOOT OPERATED CONTROLLING DEVICE

(71) Applicant: HIWIN TECHNOLOGIES CORP., Taichung (TW)

(72) Inventors: Zi-Wei Kuo, Taichung (TW); Cheng-Tang Ke, Taichung (TW)

(73) Assignee: HIWIN TECHNOLOGIES CORP., Taichung (TW)

( * ) Notice: Subject to any disclaimer, the term of this patent is extended or adjusted under 35 U.S.C. 154(b) by 3 days.

(21) Appl. No.: 16/237,752

(22) Filed: Jan. 2, 2019

(51) Int. Cl.
*G05G 1/46* (2008.04)
*G05G 5/05* (2006.01)
*G05G 1/445* (2008.04)

(52) U.S. Cl.
CPC ..... *G05G 1/46* (2013.01); *G05G 1/445* (2013.01); *G05G 5/05* (2013.01); *G05G 2505/00* (2013.01)

(58) Field of Classification Search
CPC ..... G05G 1/46; G05G 1/445; G05G 5/05; G05G 2505/00; Y10T 74/20055; Y10T 774/2054; A61B 34/25; A61B 34/35; A61B 34/70; A61B 34/76
See application file for complete search history.

(56) References Cited

U.S. PATENT DOCUMENTS

| | | | | |
|---|---|---|---|---|
| 9,494,966 | B2 * | 11/2016 | Asano | G05G 9/047 |
| 2018/0132948 | A1 * | 5/2018 | Mercado | A61B 34/25 |
| 2018/0253121 | A1 * | 9/2018 | Stuart | G05G 1/44 |

FOREIGN PATENT DOCUMENTS

| | | | |
|---|---|---|---|
| JP | S58-138222 | U | 9/1983 |
| JP | S61-174345 | U | 10/1986 |
| JP | S62-89342 | U | 6/1987 |
| JP | H05-504860 | A | 7/1993 |
| JP | 2007-26743 | A | 2/2007 |
| JP | 2016-220854 | A | 12/2016 |
| WO | 2008/052321 | A1 | 5/2008 |

* cited by examiner

*Primary Examiner* — Patrick Cicchino
(74) *Attorney, Agent, or Firm* — Winston Hsu

(57) ABSTRACT

A foot operated controlling device comprises an oriental base, a pedal, a sensing module and a transmission mechanism. The pedal is connected to the oriental base and tiltable relative to the oriental base. The sensing module comprises a first sensor and a second sensor. The transmission mechanism is connected to the pedal and the sensing module. The transmission mechanism comprises a transmission rod and a swing rod. The transmission rod is connected to the pedal. The swing rod is connected to the transmission rod, and an extension direction along which the swing rod is oriented is independent of an extension direction along which the transmission rod is oriented.

10 Claims, 12 Drawing Sheets

FOOT OPERATED CONTROLLING DEVICE

BACKGROUND OF THE INVENTION

1. Field of the Invention

The present invention is related to a foot operated controlling device, and more particularly, to a foot operated controlling device with a pedal tiltable in eight orientations.

2. Description of the Prior Art

Foot operated controlling devices are widely used in transmission, music and medical areas. In the medical field, physicians are able to control the position of the medical robot arm or the endoscopes by using the foot pedal when using surgical operating instruments with both hands, thereby improving efficiency of the operation. However, the conventional foot operated controlling devices use complicated mechanism. For example, Taiwanese patent publication number 1555497 discloses a foot operated controlling device suitable for several directions, wherein a pedal and sensors are stacked up, leading to increase of the entire height of the device. This arrangement does not comply with human factor engineering and makes the physicians uncomfortable since their heels are incapable of landing during operating. Moreover, common foot operated controlling devices only support basic orientations such as front, rear, left and right. When number of the orientations in which the pedal tilts increases, the number of electric components or membrane sensing components also increases, which results in rise of probability of malfunction of the device.

SUMMARY OF THE INVENTION

The present invention relates to a foot operated controlling device with a pedal tiltable in multiple orientations. The device is capable of detecting correct directional signals through a simple transmission mechanism and sensing module.

According to an embodiment of the present invention, a foot operated controlling device comprises an oriental base, a pedal, a sensing module and a transmission mechanism. The pedal is connected to the oriental base and tiltable relative to the oriental base. The sensing module comprises a first sensor and a second sensor. The transmission mechanism is connected to the pedal and the sensing module. The transmission mechanism comprises a transmission rod and a swing rod. The transmission rod is connected to the pedal. The swing rod is connected to the transmission rod. An extension direction along which the swing rod is oriented is independent of an extension direction along which the transmission rod is oriented. When the pedal tilts relative to the oriental base to a first position, the pedal drives the transmission rod to move, so as to trigger the first sensor. When the pedal tilts relative to the oriental base to a second position, the pedal drives the transmission rod to rotate the swing rod, so as to trigger the second sensor. When the pedal tilts relative to the oriental base to a third position, the pedal drives the transmission rod to move, so as to trigger the first sensor and rotate the swing rod to trigger the second sensor.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
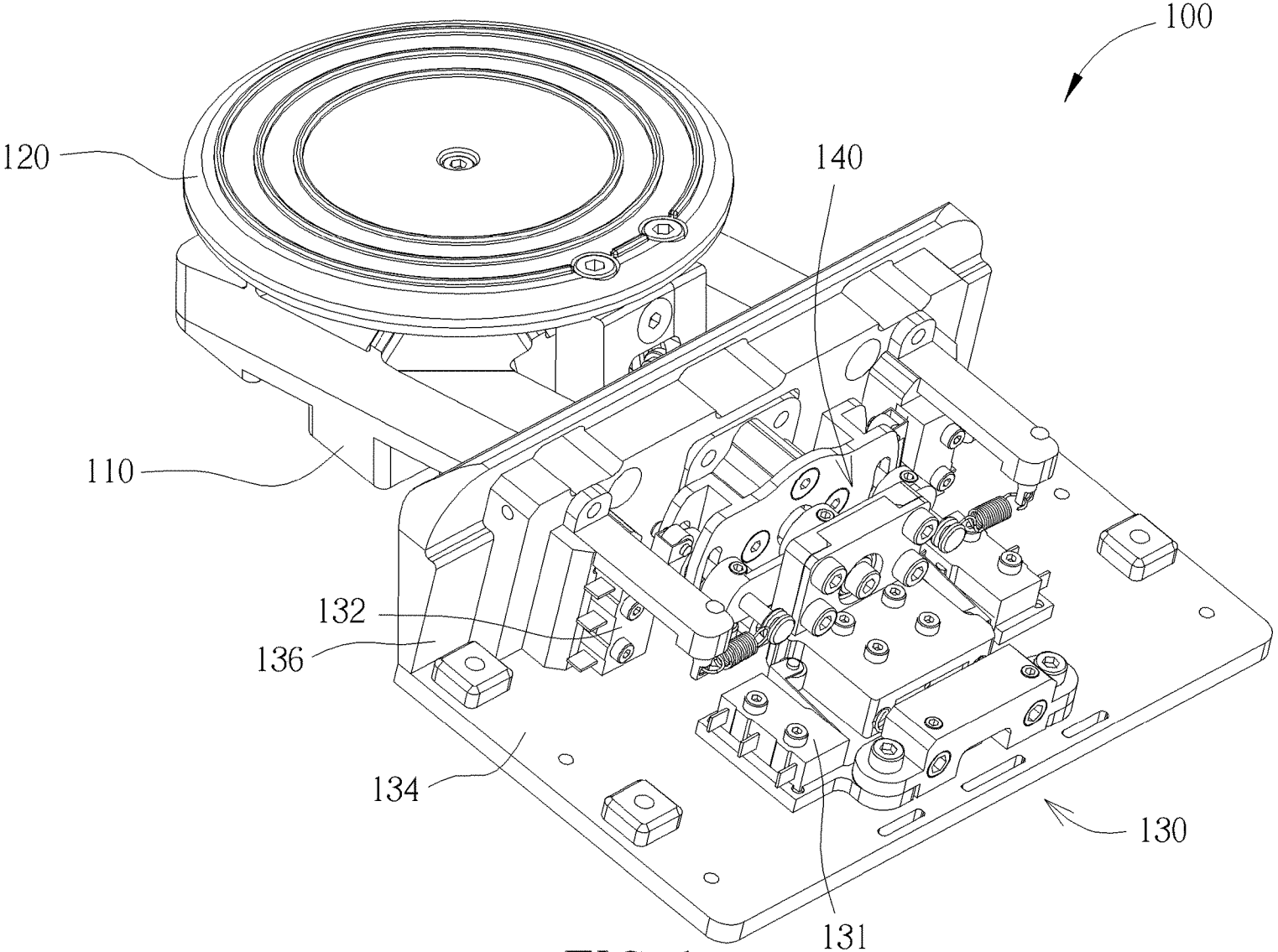
FIG. 1 is a perspective diagram of afoot operated controlling device according to an embodiment of the present invention.
Figure 2:
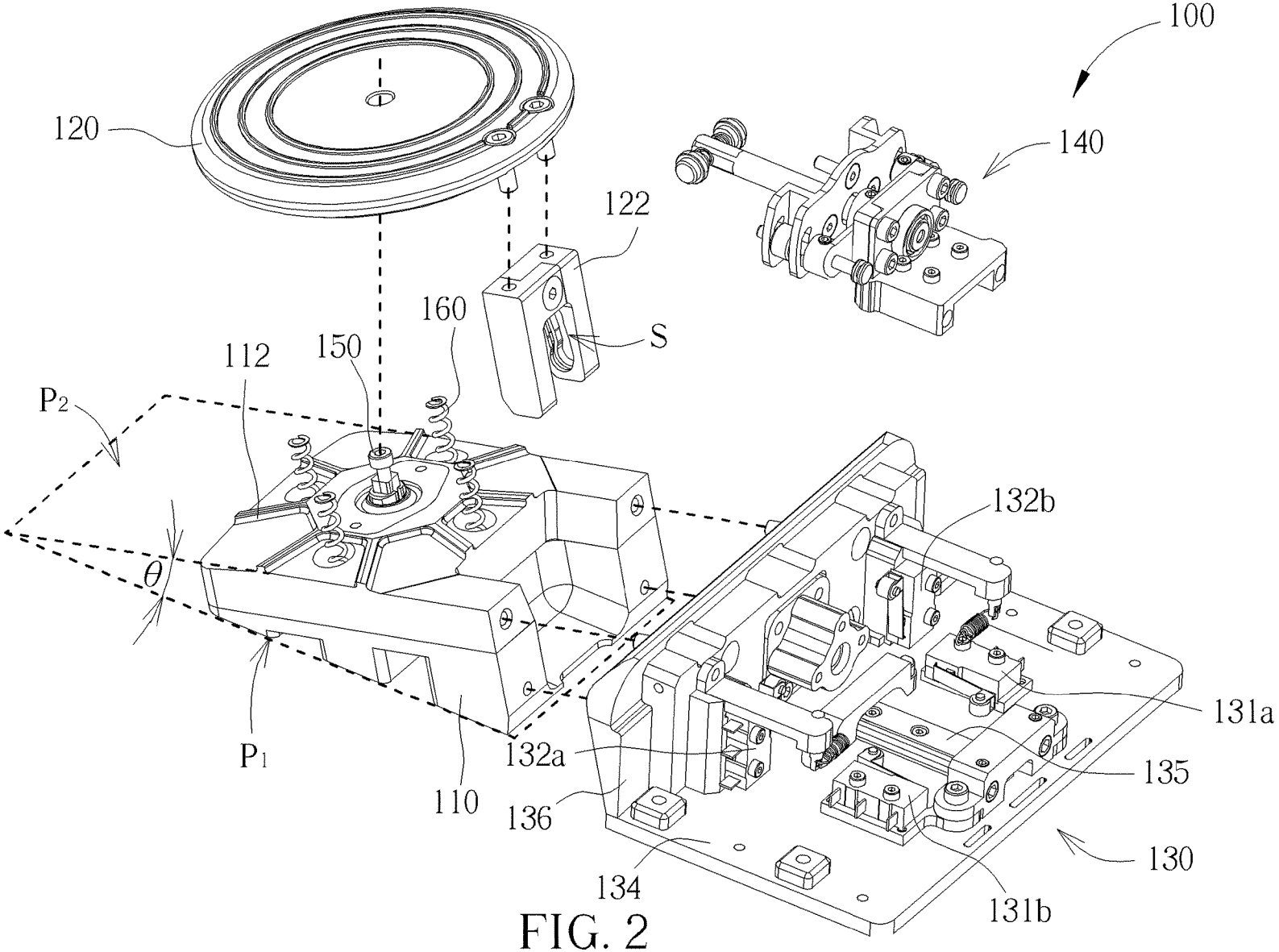
FIG. 2 is an explosion diagram of the foot operated controlling device in FIG. 1.

FIG. 1 is a perspective diagram of a foot operated controlling device according to an embodiment of the present invention. FIG. 2 is an explosion diagram of the foot operated controlling device in FIG. 1. Referring to FIG. 1 and FIG. 2, the foot operated controlling device 100 in the embodiment includes an oriental base 110, a pedal 120, a sensing module 130 and a transmission mechanism 140, and the pedal 120 is connected to the oriental base 110 and tiltable relative to the oriental base 110. The transmission mechanism 140 is connected to the pedal 120 and the sensing module 130. In the following description, an orientation of the oriental base 110 toward the sensing module 130 is defined as front, and the other orientations such as rear, left, right, top and down are accordingly defined.

Specifically, the foot operated controlling device 100 includes a central shaft 150 connecting the pedal 120 and the oriental base 110. The pedal 120 is adapted to carrying a foot portion of a user and tiltable relative to the oriental base 110 by changing stepping locations. In the embodiment, the oriental base 110 has a first plane $P_1$ and a second plane $P_2$. An angle θ is included between the first plane $P_1$ and the second plane $P_2$, and the angle θ is an acute angle. The pedal 120 is disposed on the second plane $P_2$. When the user steps on the pedal 120 by a front end of his/her foot, a rear end of his/her foot is capable of landing naturally, thereby relieving the fatigue.

On the other hand, the sensing module 130 includes a first sensor 131, a second sensor 132 and a sensing base 134, and the first sensor 131 and the second sensor 132 are disposed on the sensing base 134. In the embodiment, the first sensor 131 includes a first sensing member 131*a* and a second sensing member 131*b*, while the second sensor 132 includes a third sensing member 132*a* and a fourth sensing member 132*b*. In addition, the sensing base 134 includes a wall 136, and the first sensor 131, the second sensor 132 and the oriental base 110 are respectively located at two sides of the wall 136. Since the sensing module 130 is independent of the oriental base 110, the entire height of the oriental base 110 can be decreased. Besides, the first sensor 131 and the second sensor 132 are located at the front side of the wall 136, such that an effect of water-proof can be effectively achieved. Therefore, liquid splashed during operation can be isolated and probable damages of the first sensor 131 or the second sensor 132 can be prevented. The arrangement is also in accordance with a sterilization process of surgical instruments.

As shown in FIG. 2, a plurality of flanges 112 are disposed on the oriental base 110. When the user steps on the pedal 120, the pedal 120 is tiltable relative to the oriental base 110 and capable of abutting against a part of the flanges 112. Specifically, in the embodiment, there are eight flanges 112. When the user steps on the pedal 120, the pedal 120 is able to abut against two adjacent flanges 112 of the eight flanges 112 and located into an interval between the two adjacent flanges 112 so as to restrict the tilting orientations to eight orientations as front, rear, left, right, left front, right front, left rear and right rear. In addition, flanges 112 also provide tactile feedbacks for the user to detect whether the pedal 120 tilts to a specific position. Moreover, the foot operated controlling device 100 further includes a plurality of elastic members 160 connecting the oriental base 110 and the pedal 120, and the elastic members 160 are symmetrically disposed relative to the central shaft 150. In the embodiment, the elastic members 160 are springs and the number of which is four. The four springs are disposed at front, rear, left and right of the pedal 120, so that the pedal 120 can recover to where the pedal 120 is not stepped when loadings on the pedal 120 are removed.

Figure 3:
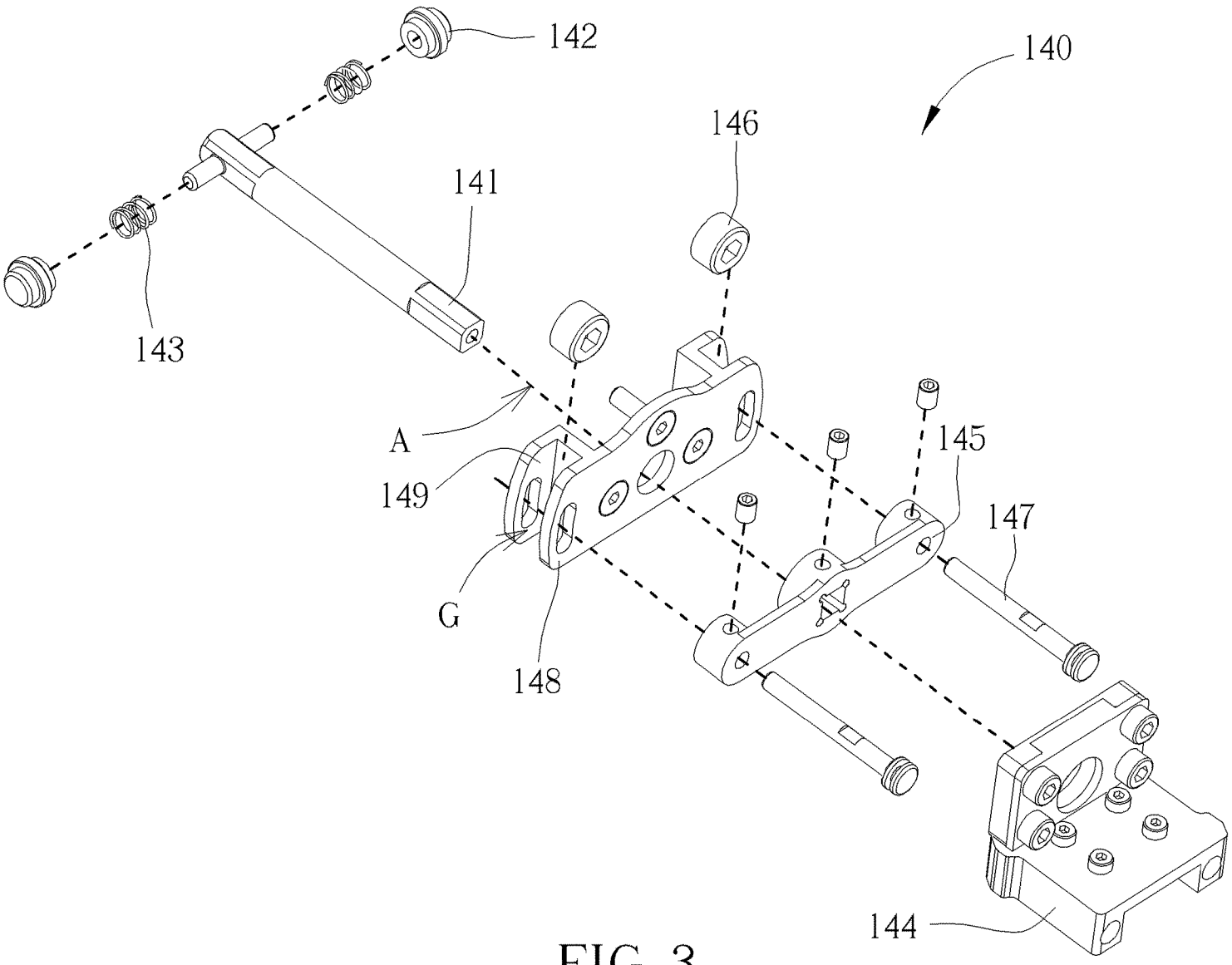
FIG. 3 is an explosion diagram of the transmission mechanism in FIG. 2.

FIG. 3 is an explosion diagram of the transmission mechanism in FIG. 2. Referring to FIG. 2 and FIG. 3, the transmission mechanism 140 in the embodiment includes a transmission rod 141 and a swing rod 145, and the transmission rod 141 is connected to the pedal 120. The swing rod 145 is connected to the transmission rod 141, and an extension direction along which the swing rod 145 is oriented is independent of an extension direction along which the transmission rod 141 is oriented. In the embodiment, an end of the transmission rod 141 is a rectangular-shaped rod, and a portion of the swing rod 145 connected to the transmission rod 141 is a corresponding rectangular-shaped hole. The swing rod 145 and the transmission rod 141 are perpendicular to each other, so that the swing rod 145 is able to synchronously rotate with the transmission rod 141 without relative rotation. In detail, the transmission rod 141 has at least one constraining portion 142 and at least one elastic member 143. In the embodiment, the constraining portions 142 and the elastic members 143 are located at two sides of an end of the transmission rod 141, and the pedal 120 includes a first constraining member 122, wherein the first constraining member 122 has a slot S. The end of the transmission rod 141 is movably arranged in the slot S via the constraining portions 142.

Moreover, in the embodiment, the first constraining member 122 is connected to a front end of the pedal 120 and fixed to the pedal 120 through fixing members such as rivets. Besides, the sensing module 130 further includes a slide rail 135 disposed on the sensing base 134. The transmission mechanism 140 further includes a first contacting member 144 connected to the transmission rod 141 and the slide rail 135, and the first contacting member 144 is slidable on the slide rail 135 within a limited range.

On the other hand, in the embodiment, the transmission mechanism 140 further includes two second contacting members 146, two connecting members 147 and a second constraining member 148, and the second constraining member 148 is connected to the wall 136. The second contacting members 146 and the connecting members 147 are respectively disposed on two sides of the swing rod 145. The connecting members 147 connect the swing rod 145 and the corresponding second contacting members 146. Specifically, the second constraining member 148 has grooves G, and the connecting members 147 are movably constrained in the grooves G. When the pedal 120 tilts, the swing rod 145 rotates around an axis of the transmission rod 141 (i.e., axis A), and the connecting members 147 drive the second contacting members 146 to move in the grooves G. Besides, in the embodiment, the second constraining member 148 further includes a pair of constraining structures 149 aligned in the axial direction. There is a space between the pair of constraining structures 149. When the swing rod 145 translates along the axis of the transmission rod 141, the second contacting members 146 are constrained in the space between the constraining structures 149, and thus axial translation of the second contacting members 146 with the swing rod 145 and the connecting members 147 is prevented.

Figure 4:
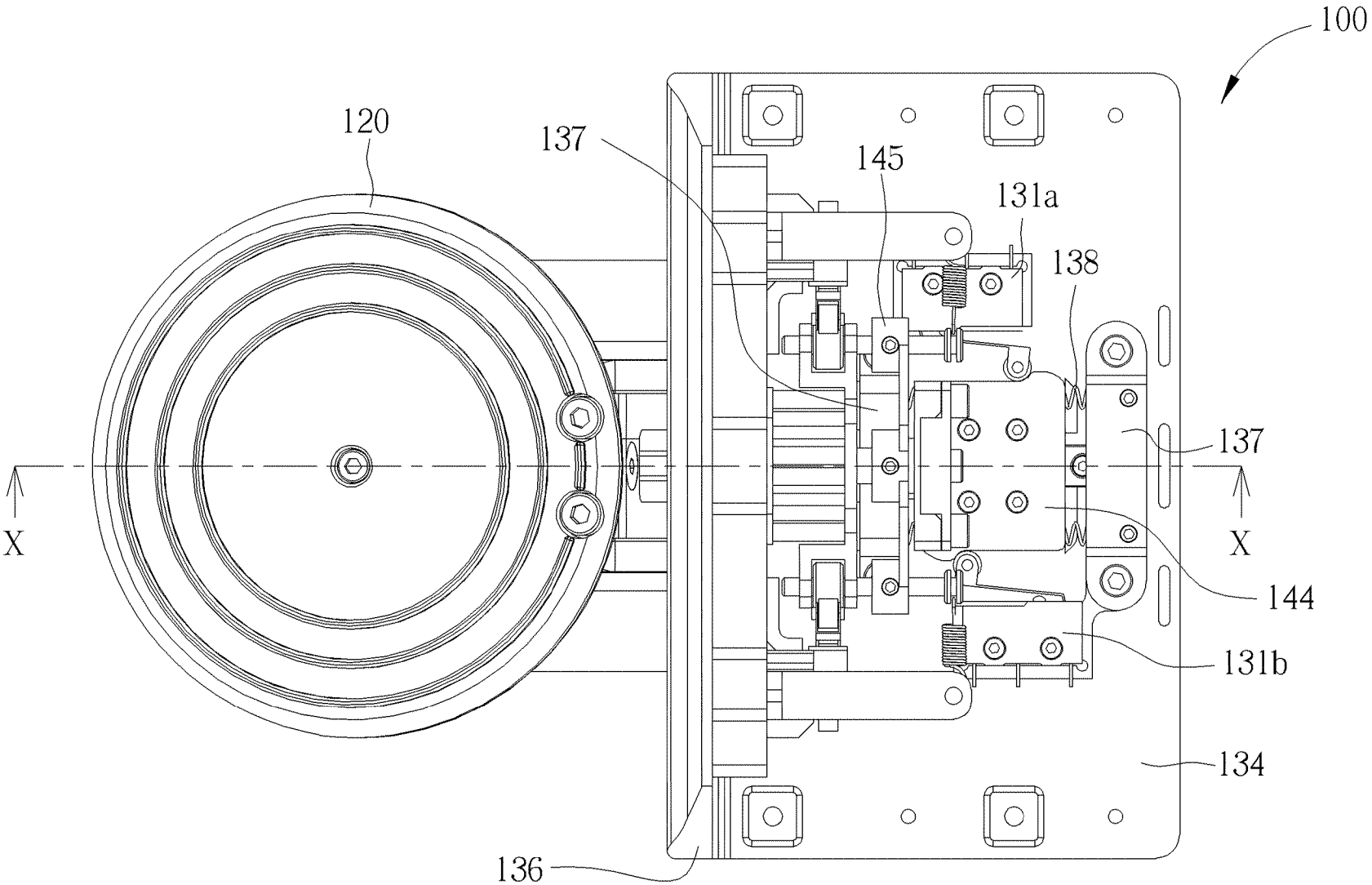
FIG. 4 is a top view of the foot operated controlling device in FIG. 1 without tilt of the pedal.
Figure 5:
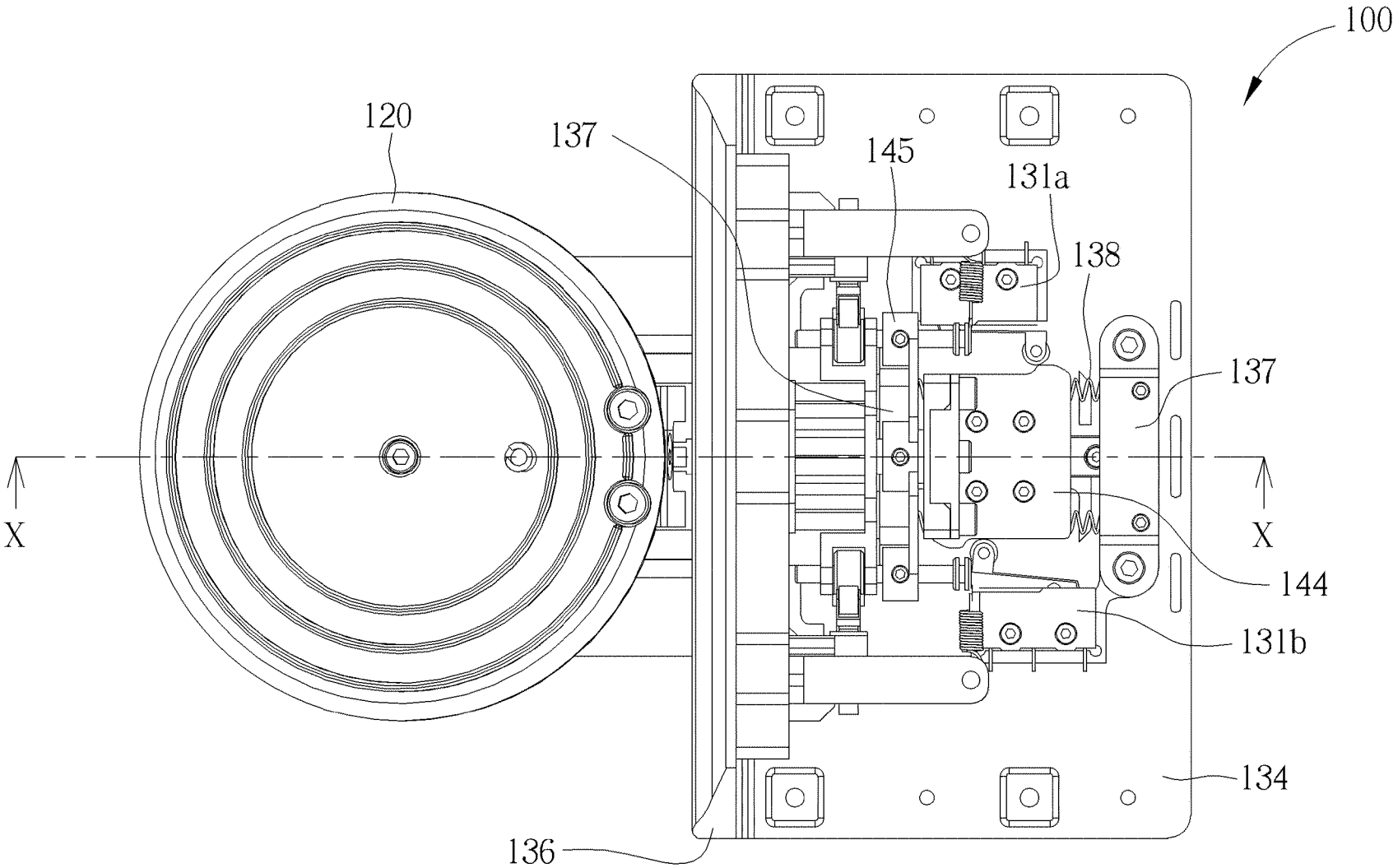
FIG. 5 is a top view of the foot operated controlling device in FIG. 1 when the pedal tilts toward the sensing base to a position.
Figure 6:
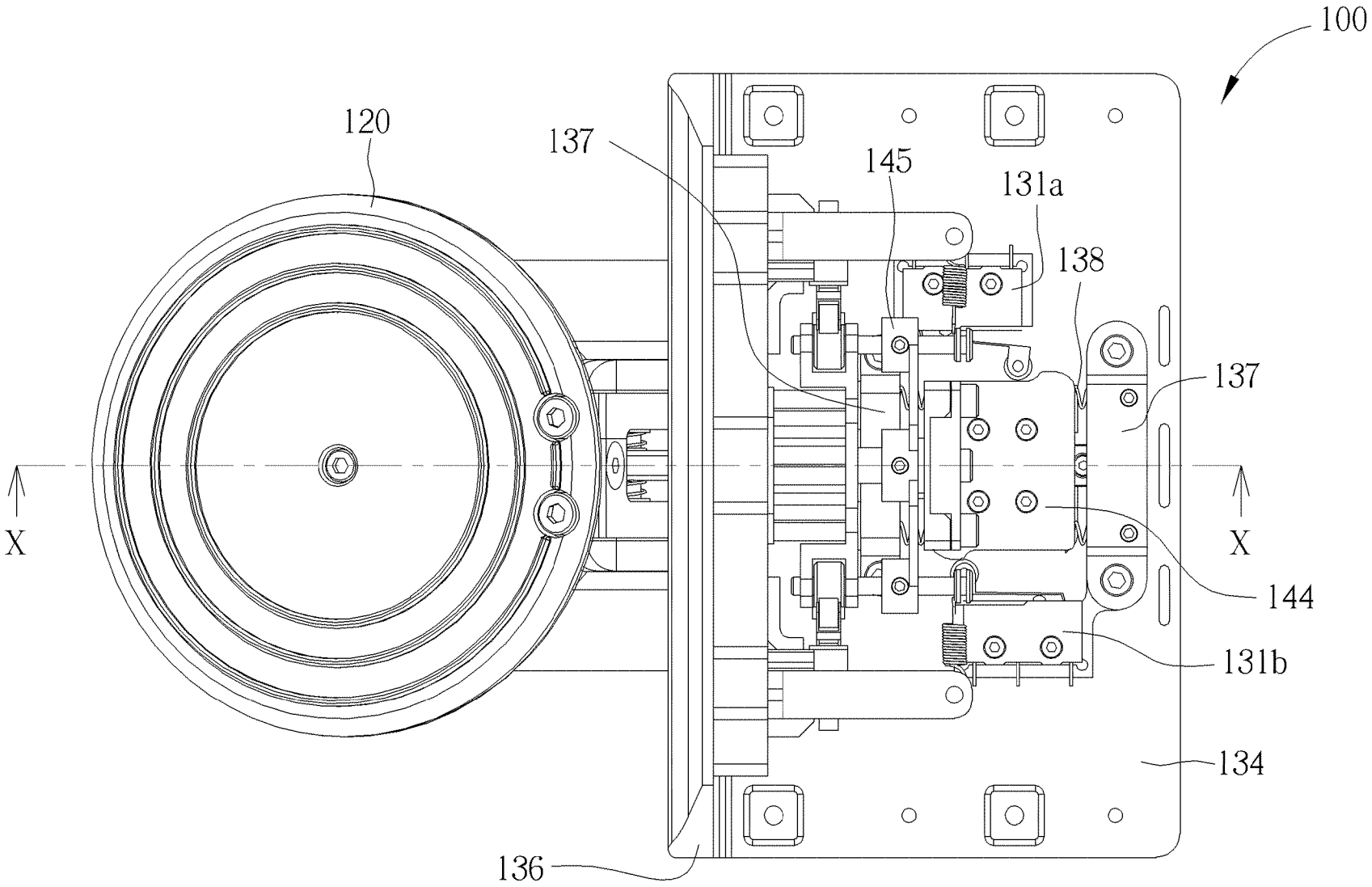
FIG. 6 is a top view of the foot operated controlling device in FIG. 1 when the pedal tilts away from the sensing base to another position.

FIG. 4 is a top view of the foot operated controlling device in FIG. 1 without tilt of the pedal. FIG. 5 is a top view of the foot operated controlling device in FIG. 1 when the pedal tilts toward the sensing base to a position. FIG. 6 is a top view of the foot operated controlling device in FIG. 1 when the pedal tilts away from the sensing base to another position. Referring to FIG. 4 to FIG. 6, in the embodiment, two blocking members 137 are disposed on the sensing base 134. The blocking members 137 are respectively located at a front side and a rear side of the first contacting member 144 to limit a translational stroke of the first contacting member 144. Besides, elastic members 138 are disposed between the first contacting member 144 and the blocking members 137 to prevent the first contacting member 144 from damage due to striking the blocking members 137 during the translation. In addition, when the pedal 120 is unloaded, the first contacting member 144 is ensured to be held at the original state. When the pedal 120 is stepped on and tilts forward (as shown in FIG. 5), the pedal 120 drives the transmission rod 141 to move backward and drive the first contacting member 144 to move backward relative to the slide rail 135 so as to trigger the first sensing member 131*a*. When the pedal 120 is stepped on and tilts backward (as shown in FIG. 6), the pedal 120 drives the transmission rod 141 to move forward and drive the first contacting member 144 to move forward relative to the slide rail 135 so as to trigger the second sensing member 131*b*.

Figure 7:
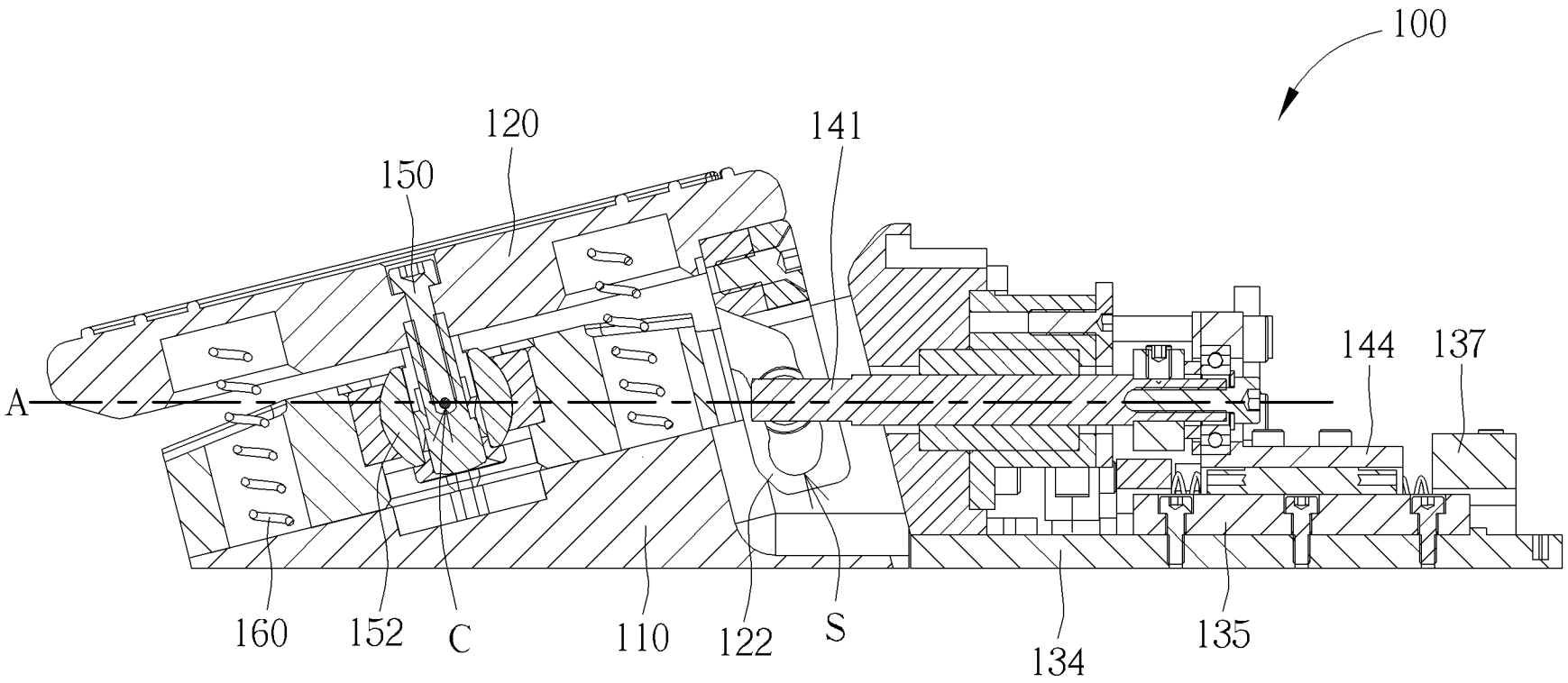
FIG. 7 is a cross-sectional view of the foot operated controlling device along the X-X cross section in FIG. 4.
Figure 8:
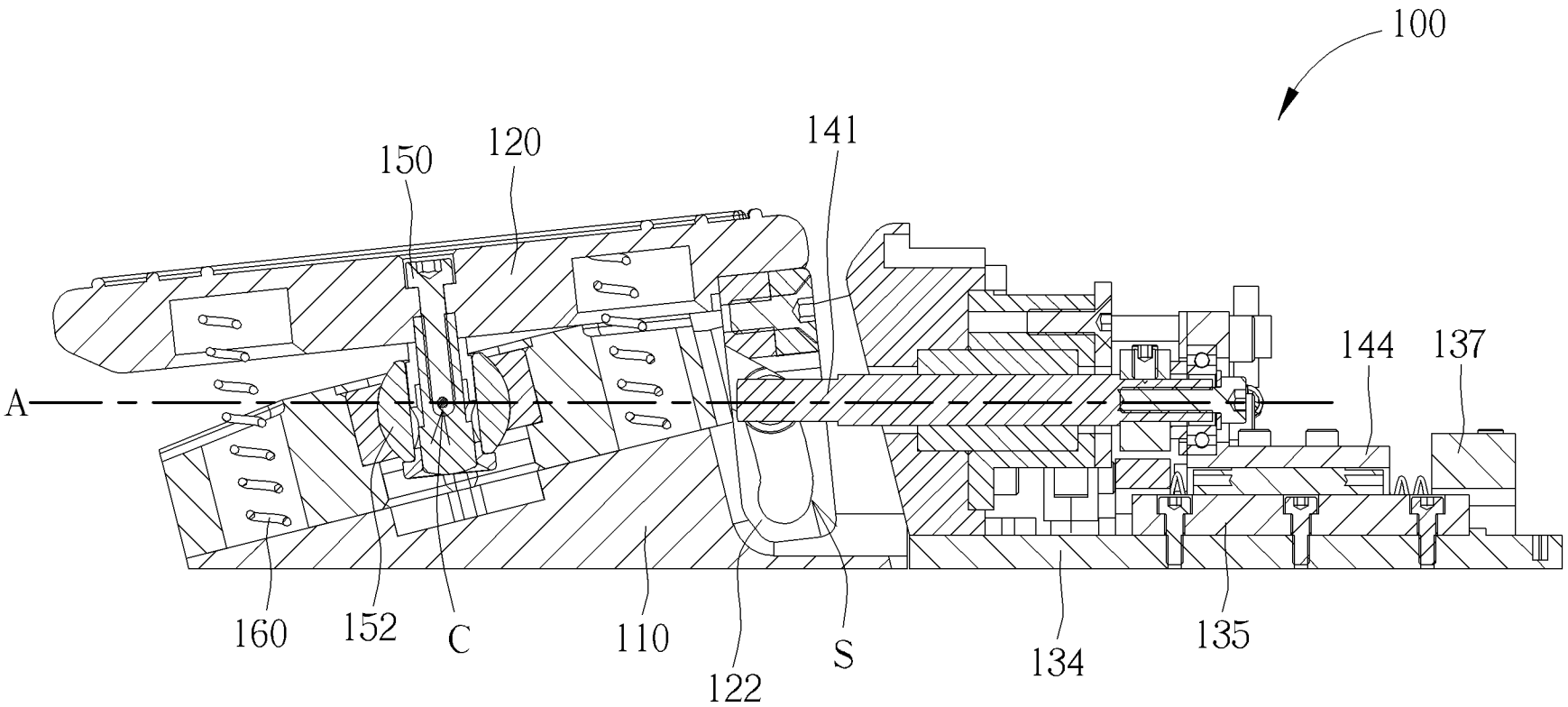
FIG. 8 is a cross-sectional view of the foot operated controlling device along the X-X cross section in FIG. 5.
Figure 9:
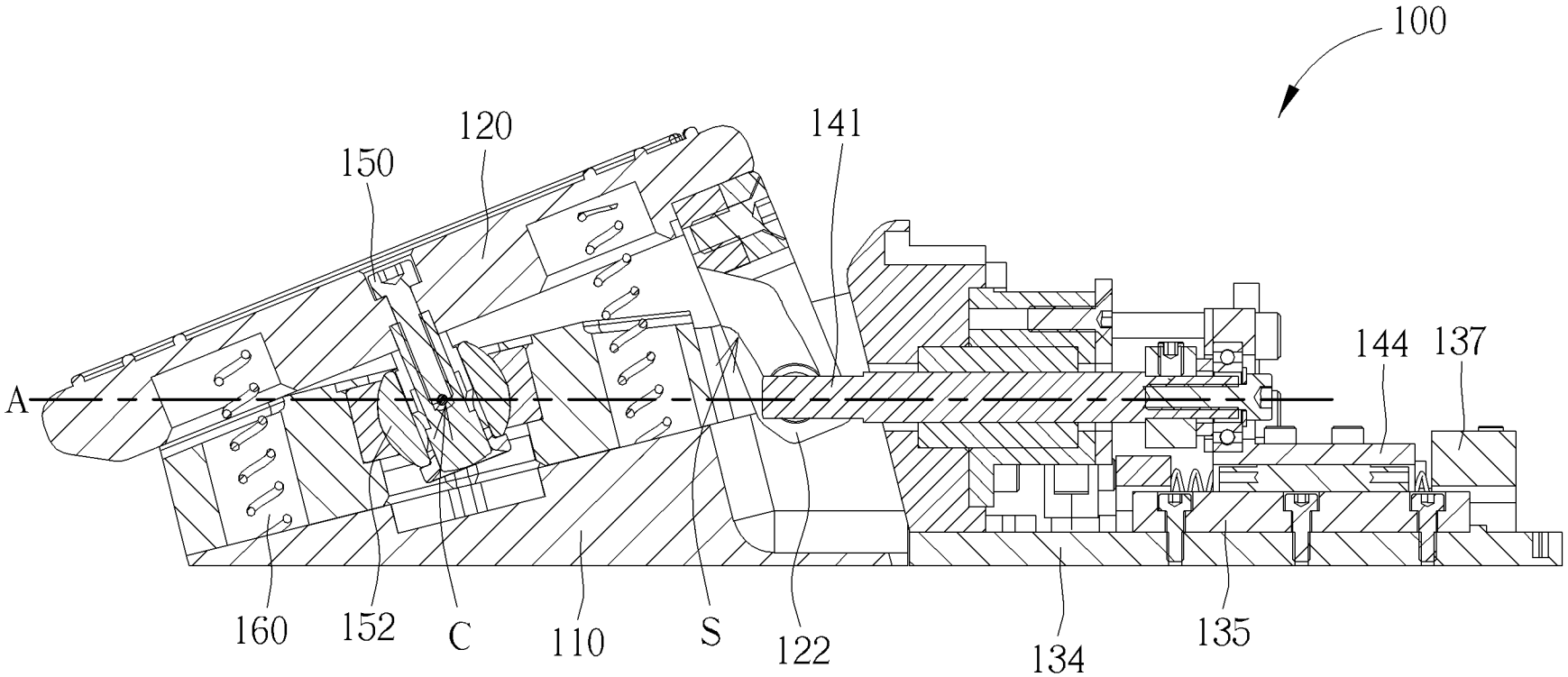
FIG. 9 is a cross-sectional view of the foot operated controlling device along the X-X cross section in FIG. 6.

In order to illustrate the operating state of the pedal 120 and the transmission rod 141 clearer, please refer to FIG. 7 to FIG. 9. FIG. 7 is a cross-sectional view of the foot operated controlling device along the X-X cross section in FIG. 4. FIG. 8 is a cross-sectional view of the foot operated controlling device along the X-X cross section in FIG. 5. FIG. 9 is a cross-sectional view of the foot operated controlling device along the X-X cross section in FIG. 6. In the embodiment, the foot operated controlling device 100 includes a bearing 152 connecting the oriental base 110 and the central shaft 150. The bearing 152 is a ball bearing and thus can be fixed in a central part of the oriental base 110 in accordance with the tilt of the pedal 120. On the other hand, the slot S includes an upper portion and a lower portion. When the pedal 120 is not stepped on (as shown in FIG. 7), an end of the transmission rod 141 is located at middle of the slot S between the upper portion and the lower portion. When the pedal 120 is stepped on and tilts forward (as shown in FIG. 8), the first constraining member 122 moves downward, and the end of the transmission rod 141 constrained in the slot S (i.e., constraining portions 142) moves to the upper portion of the slot S, so that the transmission rod 141 drives the first contacting member 144 to move backward. When the pedal 120 is stepped on and tilts backward (as shown in FIG. 9), the first constraining member 122 moves upward, and the end of the transmission rod 141 constrained in the slot S (i.e., constraining portions 142) moves to the lower portion of the slot S, so that the transmission rod 141 drives the first contacting member 144 to move forward. It should be noticed that a center C of the bearing 152 is held in the extension direction along which the transmission rod 141 is oriented (i.e., axis A) throughout the entire process. This arrangement can ensure that the tilt of the pedal 120 is not affected by the displacement of the transmission rod 141, and the tilt is thus more accurate.

Figure 10:
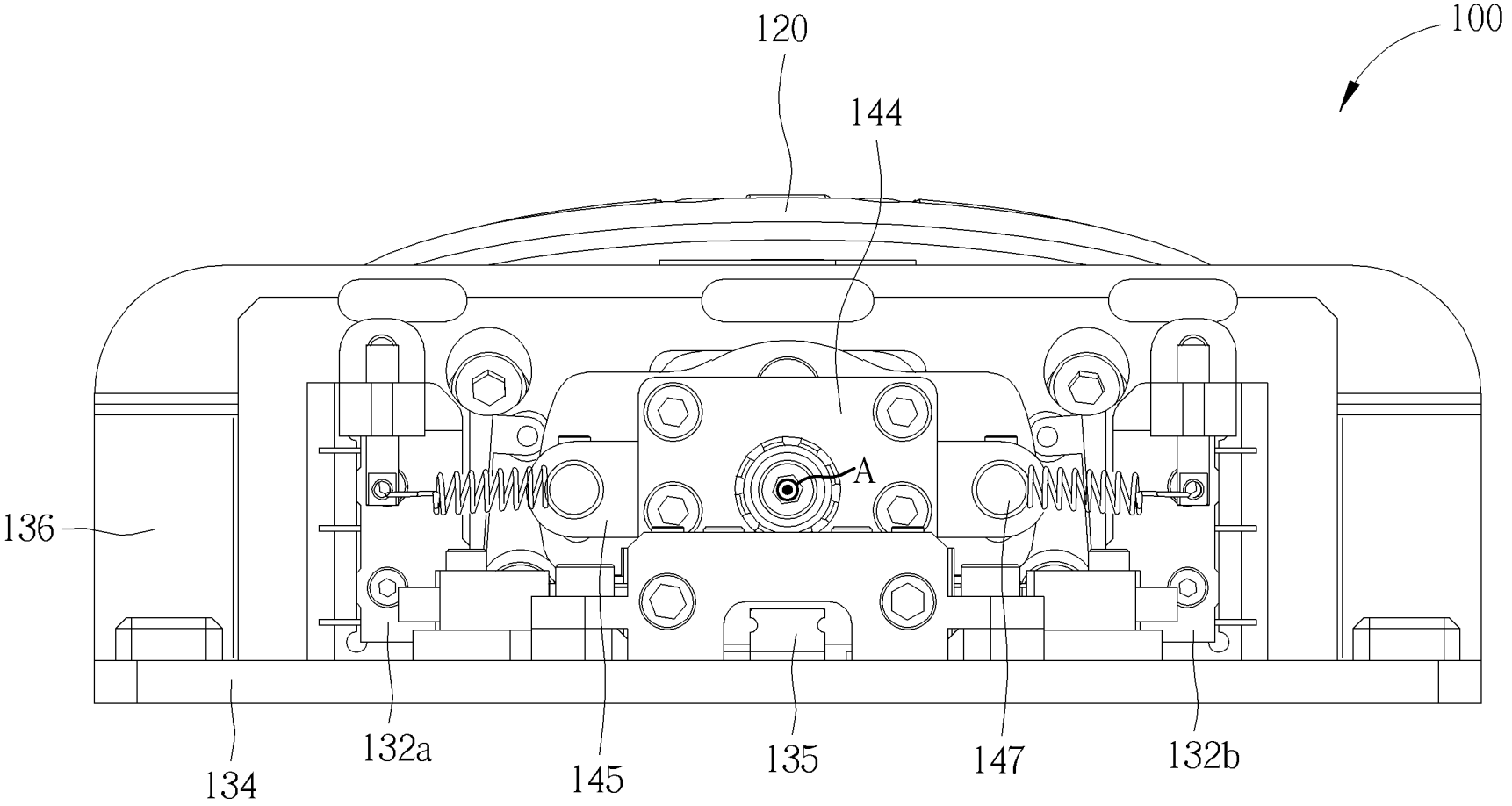
FIG. 10 is a front view of the foot operated controlling device in FIG. 1 without tilt of the pedal.
Figure 11:
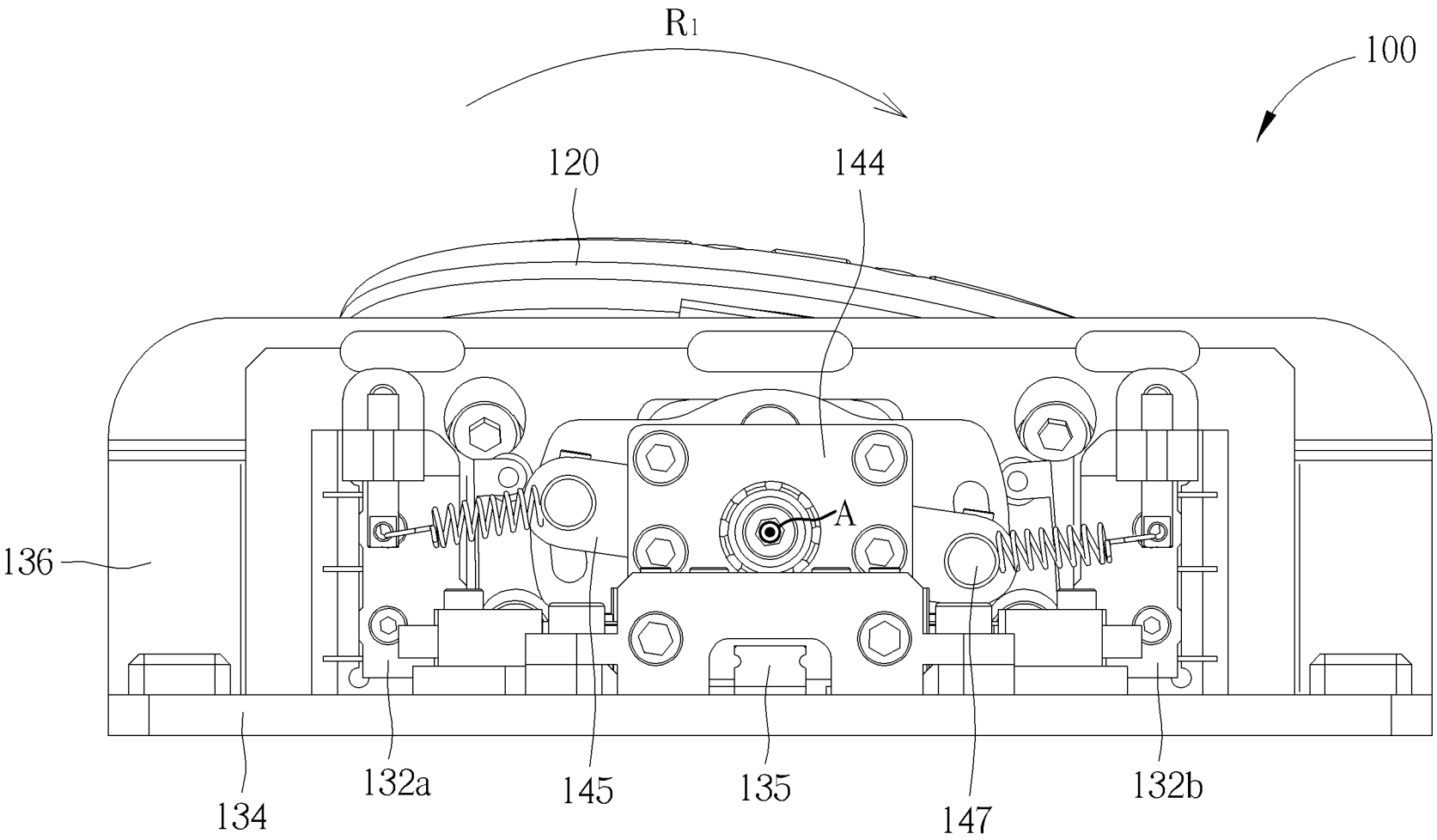
FIG. 11 is a front view of the foot operated controlling device in FIG. 1 when the pedal tilts around an axis A to a position.
Figure 12:
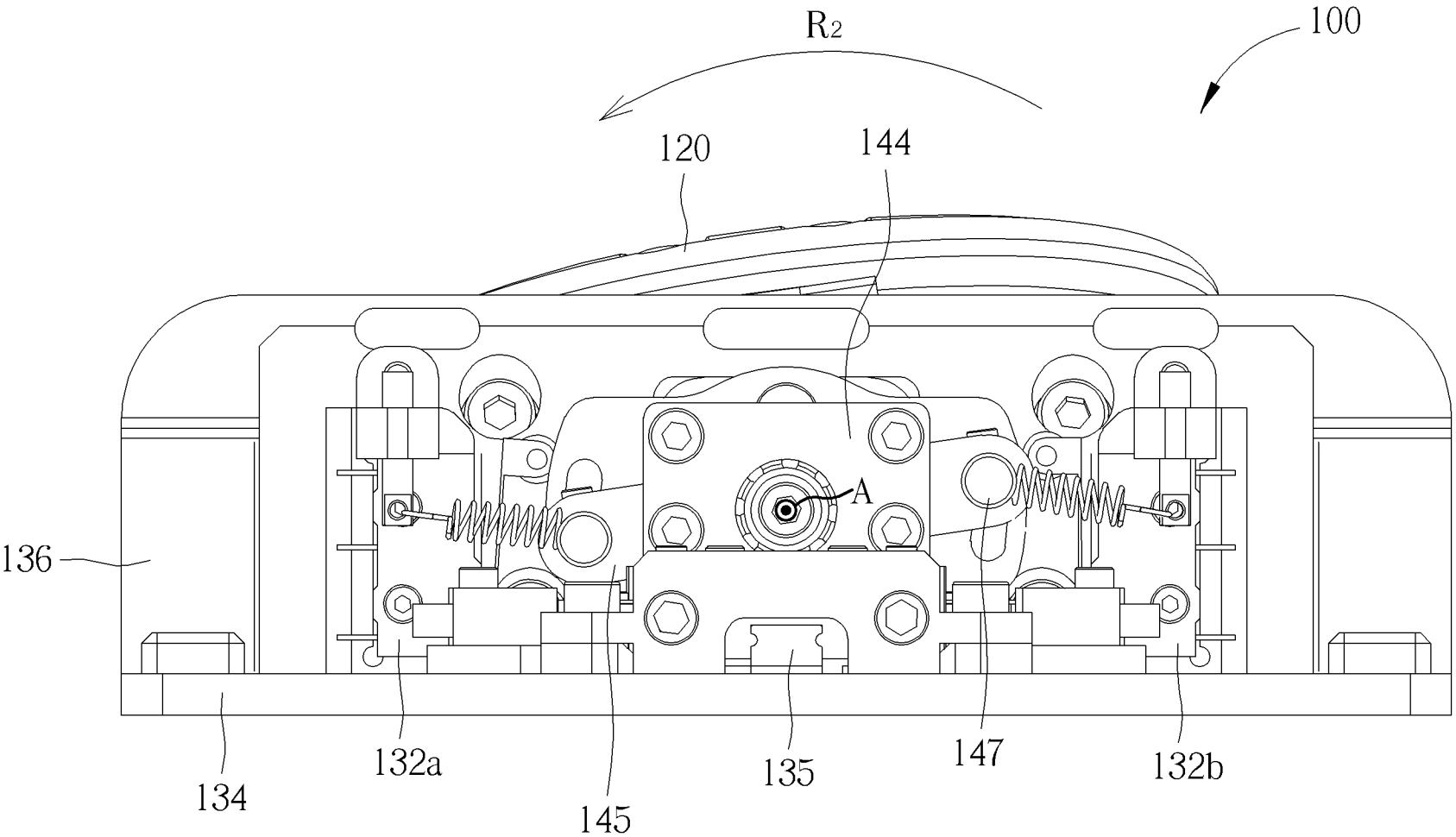
FIG. 12 is a front view of the foot operated controlling device in FIG. 1 when the pedal tilts around the axis A to another position.

FIG. 10 is a front view of the foot operated controlling device in FIG. 1 without tilt of the pedal. FIG. 11 is a front view of the foot operated controlling device in FIG. 1 when the pedal tilts around an axis A to a position. FIG. 12 is a front view of the foot operated controlling device in FIG. 1 when the pedal tilts around the axis A to another position. Referring to FIG. 10 to FIG. 12, when the pedal 120 does not tilt (as shown in FIG. 10), the swing rod 145 keeps horizontal and the second sensor 132 is not triggered. When the pedal 120 tilts clockwise along a direction R1 as shown in FIG. 11, the pedal 120 drives the transmission rod 141 to rotate the swing rod 145 around the axis A clockwise and the swing rod 145 drives the second contacting member 146 to trigger the third sensing member 132*a*. When the pedal 120 tilts counterclockwise along a direction R2 as shown in FIG. 12, the pedal 120 drives the transmission rod 141 to rotate the swing rod 145 around the axis A counterclockwise and the swing rod 145 drives the second contacting member 146 to trigger the fourth sensing member 132*b*.

Since the translation of the transmission rod 141 in the axial direction and the rotation of the swing rod 145 around the axis A are independent of each other, signals detected by the first sensor 131 and the second sensor 132 can be processed individually and superposed, and information of the eight directions can be composed. The detailed relationship can be identified by the following table:

TABLE 1

Signals of sensing members and corresponding directions

| | First sensor | | Second sensor | | |
|---|---|---|---|---|---|
| Mode | First sensing member | Second sensing member | Third sensing member | Fourth sensing member | Orientation |
| 1 | + | − | − | − | Front |
| 2 | − | + | − | − | Rear |
| 3 | − | − | + | − | Left |
| 4 | − | − | − | + | Right |
| 5 | + | − | + | − | Left front |
| 6 | + | − | − | + | Right front |
| 7 | − | + | + | − | Left rear |
| 8 | − | + | − | + | Right rear |

(+: sensing member is triggered; −: sensing member is untriggered)

In summary, the foot operated controlling device of the present invention is able to decompose two dimensional motion of the pedal into two independent signals through the translation of the transmission rod and the rotation of the swing rod, and compose the signals of the corresponding directions by superposition principle to provide correct directional information. Therefore, the number of electric components and sensing components can be effectively reduced. Besides, the composition of the transmission mechanism is simple, so the device can be minimized to make the user more comfortable and convenient.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A foot operated controlling device, comprising:

an oriental base;

a pedal connected to the oriental base and tiltable relative to the oriental base;

a sensing module comprising a first sensor and a second sensor; and a transmission mechanism connected to the pedal and the sensing module, the transmission mechanism comprising:

a transmission rod connected to the pedal; and a swing rod connected to the transmission rod, an extension direction along which the swing rod is oriented being independent of an extension direction along which the transmission rod is oriented;

wherein, when the pedal tilts relative to the oriental base to a first position, the pedal drives the transmission rod to move, so as to trigger the first sensor;

wherein, when the pedal tilts relative to the oriental base to a second position, the pedal drives the transmission rod to rotate the swing rod, so as to trigger the second sensor;

wherein, when the pedal tilts relative to the oriental base to a third position, the pedal drives the transmission rod to move, so as to trigger the first sensor and rotate the swing rod to trigger the second sensor.

2. The foot operated controlling device of claim 1, wherein the oriental base has a first plane and a second plane, an angle is included between the first plane and the second plane, and the pedal is disposed on the second plane.

3. The foot operated controlling device of claim 1, wherein a plurality of flanges are disposed on the oriental base, and the pedal is tiltable relative to the oriental base and capable of abutting against a part of the flanges.

4. The foot operated controlling device of claim 1, wherein the pedal comprises a first constraining member, the first constraining member has a slot, and an end of the transmission rod is movably arranged in the slot.

5. The foot operated controlling device of claim 4, wherein the slot comprises two portions, when the pedal tilts relative to the oriental base to the first position or the third position, the end of the transmission rod moves to one of the two portions.

6. The foot operated controlling device of claim 1, wherein the sensing module further comprising:

a sensing base; and a slide rail, wherein the first sensor, the second sensor and the slide rail are disposed on the sensing base;

wherein, the transmission mechanism further comprises a first contacting member connected to the transmission rod and the slide rail, when the pedal tilts relative to the oriental base to the first position or the third position, the transmission rod is moved in a direction, so as to drive the first contacting member to move for triggering the first sensor.

7. The foot operated controlling device of claim 6, wherein the sensing base further comprises a wall, the first sensor, the second sensor and the oriental base are respectively located at two sides of the wall, and the transmission mechanism further comprises:

a second contacting member; and a connecting member connecting the swing rod and the second contacting member;

wherein, when the pedal tilts relative to the oriental base to the second position or the third position, the swing rod rotates around an axis and drives the second contacting member to trigger the second sensor.

8. The foot operated controlling device of claim 7, wherein the transmission mechanism further comprises a second constraining member, the second constraining member is connected to the wall and has a groove, and the connecting member is movably arranged in the groove.

9. The foot operated controlling device of claim 1, further comprising a central shaft and a bearing connected to the pedal and the oriental base, a center of the bearing being located at the extension direction of the transmission rod.

10. The foot operated controlling device of claim 9, further comprising a plurality of elastic members connecting the oriental base and the pedal, the elastic members being symmetrically disposed relative to the central shaft.

* * * * *